US006663678B2

(12) United States Patent
Strudel et al.

(10) Patent No.: US 6,663,678 B2
(45) Date of Patent: Dec. 16, 2003

(54) METHOD AND APPARATUS FOR TREATING TUBULAR KNIT GOODS

(75) Inventors: Werner Strudel, Friedrichshafen (DE); Guenter Euscher, Sigmarszell (DE); Oliver Hostenkamp, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 197 days.

(21) Appl. No.: 10/035,908

(22) Filed: Dec. 24, 2001

(65) Prior Publication Data

US 2002/0100123 A1 Aug. 1, 2002

(30) Foreign Application Priority Data

Dec. 23, 2000 (DE) ..... 100 65 171

(51) Int. Cl.[7] ..... D06B 3/10

(52) U.S. Cl. ..... 8/149.3; 68/5 D; 26/85

(58) Field of Search ..... 8/149.2, 149.3, 8/151, 152; 68/5 R, 5 D, 13 R; 34/573, 611, 618, 623, 625, 104, 105; 26/80, 81, 84, 85, 87

(56) References Cited

U.S. PATENT DOCUMENTS

| | | | | |
|---|---|---|---|---|
| 1,030,336 | A | * | 6/1912 | Shields |
| 1,313,468 | A | * | 8/1919 | Cohn |
| 1,334,164 | A | * | 3/1920 | Palmer |
| 1,401,589 | A | * | 12/1921 | Cunningham |
| 1,964,691 | A | * | 6/1934 | Shippling |
| 2,228,001 | A | * | 1/1941 | Cohn et al. |
| 2,589,345 | A | * | 3/1952 | Cohn et al. |
| 2,597,528 | A | * | 5/1952 | Redman |
| 2,750,649 | A | * | 6/1956 | Johnson |
| 3,065,097 | A | * | 11/1962 | Zupic et al. |
| 3,116,589 | A | * | 1/1964 | Eswards et al. |
| 3,257,790 | A | * | 6/1966 | Dudzik et al. |
| 3,412,411 | A | * | 11/1968 | Cohn et al. |
| 3,543,409 | A | * | 12/1970 | Fuhs et al. |
| 3,589,578 | A | * | 6/1971 | Kamphausen |
| 3,605,146 | A | * | 9/1971 | Amengual |
| 3,619,831 | A | * | 11/1971 | Oberholtzer |
| 3,944,149 | A | * | 3/1976 | Frezza |
| 4,146,946 | A | * | 4/1979 | Plaia et al. |
| 4,184,846 | A | * | 1/1980 | Diggle, Jr. |
| 4,266,893 | A | * | 5/1981 | Laszlo et al. |

(List continued on next page.)

FOREIGN PATENT DOCUMENTS

| | | | |
|---|---|---|---|
| DE | 1635348 | | 4/1971 |
| DE | 2331340 | | 1/1975 |
| DE | 2624439 | * | 12/1977 |
| DE | 2811011 | | 9/1979 |
| DE | 2828423 | * | 1/1980 |
| DE | 4131636 | | 3/1993 |
| DE | 19819051 | | 11/1999 |
| GB | 2068032 | * | 8/1981 |
| JP | 11-181670 | * | 7/1999 |

*Primary Examiner*—Frankie L. Stinson
(74) *Attorney, Agent, or Firm*—W. F. Fasse; W. G. Fasse

(57) ABSTRACT

Tubular knit goods including natural fibers and synthetic elastomeric fibers are steam treated and then circularly expanded and heat-fixed while being transported vertically downwardly over a circular spreader in a heat fixing chamber. The goods build up a buffer or excess material reserve on the conical feed section of the circular spreader, either by using a greater transport velocity into the feed section than that out of the feed section and along the spreader, or by starting to feed the goods into the feed section for a time before starting to draw the goods out of the feed section and then transporting the goods to and from the feed section at the same velocity. The goods relax in the buffer. Transporting the goods vertically downwardly over the circular spreader during the heat-fixing uses gravity advantageously, and reduces tension in the goods.

13 Claims, 2 Drawing Sheets

U.S. PATENT DOCUMENTS 4,269,046 A * 5/1981 Strahm et al.
4,305,185 A * 12/1981 Frezza
4,306,340 A * 12/1981 Strudel et al.
4,335,593 A * 6/1982 Strahm et al.
RE31,115 E * 1/1983 Catallo
4,475,417 A * 10/1984 Dornier
4,562,627 A * 1/1986 Milligan
4,608,767 A 9/1986 Dornier
4,628,712 A * 12/1986 Strudel
4,885,826 A * 12/1989 Strudel
5,077,873 A * 1/1992 Strudel
5,195,690 A * 3/1993 Cross et al.
5,776,309 A * 7/1998 Fraik
6,016,591 A 1/2000 Strudel et al.

* cited by examiner

METHOD AND APPARATUS FOR TREATING TUBULAR KNIT GOODS

PRIORITY CLAIM

This application is based on and claims the priority under 35 U.S.C. §119 of German Patent Application 100 65 171.2, filed on Dec. 23, 2000, the entire disclosure of which is incorporated herein by reference.

FIELD OF THE INVENTION

The invention relates to a method and an apparatus for treating tubular textile goods, and especially tubular knit goods containing a first portion of natural fibers and a second portion of synthetic elastomeric fibers. The treatment may involve, for example, steam treating, heating, relaxing, expanding, and/or heat fixing/setting of the goods.

BACKGROUND INFORMATION

German Patent Laying Open Publication 198 19 051 A1, and corresponding U.S. Pat. No. 6,016,591 (Strudel et al. ) disclose a method and an apparatus for treating tubular knit goods comprising a first portion of natural fibers and a second portion of synthetic elastomeric fibers. The entire disclosure of U.S. Pat. No. 6,016,591 is incorporated herein by reference, for general information, because the method and apparatus of the present application have similarities with respect to, and represent a further development of, the method and apparatus disclosed in U.S. Pat. No. 6,016,591.

In the known treatment process and apparatus according to U.S. Pat. No. 6,016,591, the tubular knit goods are transported and guided in such a manner that the goods pass along the circular internal spreader or expander arranged in the heat fixing chamber in an upward vertical direction, namely from the bottom to the top of the circular spreader in the heat fixing chamber. While the known method and apparatus according to U.S. Pat. No. 6,016,591 achieve many benefits and advantages in the treatment of the tubular knit goods, a certain disadvantage has also been discovered. Namely, due to the transport of the goods in the vertical upward direction over the circular expander in the heat fixing chamber, this gives rise to a longitudinal tension in the tubular goods, which remains and causes negative influences in the finished product, i.e. the finished treated goods. Particularly, this longitudinal tension is caused by the weight of the tubular goods, the acceleration forces of lifting the tubular goods in the upward transport, the friction of the tubular goods relative to the circumferential surface areas of the circular spreader and the pre-tension force between the fixing rollers of the circular spreader.

German Patent Laying-Open Publication 41 31 636 A1 further discloses a method and an apparatus for carrying out the hot air drying of a spread-out textile web, especially a sensitive or delicate textile web of knit or knitted goods. In the known method and apparatus, before being transported into the hot air drying zone, the knit goods in the form of a flat web are supplied with a leading advance and laid (especially in the form of folds) onto the feed end of an air-permeable carrier belt. Then the goods are transported through the drying zone on this carrier belt. The goods being transported or supplied with a "leading advance" means that a quantity of the goods is supplied in excess of or ahead of the demand of the goods being transported away by the carrier belt. The textile web can also be in the form of flat laid-out tubular goods. In order to be able to treat the spread-out flat web of goods using dry air, with an especially low tension of the goods, the known method and apparatus use at least one brush roller extending across the entire width of the flat web to form and lay uniform folds of the flat web onto the feed end of the carrier belt.

In order to subject tubular knit goods made of a first portion of natural fibers and a second portion of synthetic elastomeric fibers to a thermal fixing or heat fixing process, for technological reasons, the knit goods must be supplied to the treatment process in a form or condition other than a flat laid out form and other than a form in which the knit goods are laid out in uniform folds. Namely, such flat or folded forms of the knit goods are not suitable for uniformly carrying out the heat fixing treatment process on knit goods having natural fibers and synthetic elastomeric fibers. While the delivery of a flat web in loose uniform folds on a carrier belt may be suitable for simply heat drying the flat web of material in a low tension manner, it is not suitable for carrying out a heat fixing process, either of tubular goods or of a flat web of goods. For example, the heat fixing process requires the goods to be held and expanded in a controlled configuration with controlled expansion or tension at varying stages of the process.

SUMMARY OF THE INVENTION

In view of the above, it is an object of the invention to provide a method and an apparatus for treating tubular textile goods, and especially knit goods with a first proportion of natural fibers and a second proportion of synthetic elastomeric fibers, wherein the transport and guidance of the tubular goods over at least one circular expander or spreader is improved in such a manner so as to reduce the tension forces exerted on and in the goods. The invention further aims to avoid or overcome the disadvantages of the prior art, and to achieve additional advantages, as apparent from the present specification.

The above objects have been achieved according to the invention in a method for treating tubular textile goods, and especially knit goods with a proportion of natural fibers and a proportion of synthetic elastomeric fibers, in which the textile goods are subjected to a steam treatment process and thereafter a heat fixing process while the goods are in a circular expanded condition and being transported in a vertical direction, i.e. along a vertical axis. According to the invention, the goods are first accumulated to form a goods buffer of a loose excess quantity of the goods upstream of or before the heat fixing treatment, and the transport of the goods during the heat fixing treatment is in a vertically downward direction.

More particularly, a main treatment section of the circular spreader is arranged in the heat fixing chamber of a treatment apparatus while an inlet or feed section of the circular spreader is arranged vertically above the heat fixing chamber. The feed section has a substantially conical configuration, while the main section has a substantially cylindrical configuration which preferably has an adjustable diameter. In this context, the term "substantially" means that the configurations of the spreader sections are not truly conical or cylindrical with a truly circular cross-section, but rather the cross-sectional perimeter shape is made up, for example, of a plurality of straight segments, which may be rollers or the like. Thus, the perimeter may be an octagon, decagon, or other polygon rather than a true circle.

In the inventive method, the tubular goods are continuously fed or supplied at a first predetermined transport velocity to the feed section of the circular spreader above the heat fixing chamber whereby the tubular goods temporarily form a goods buffer or excess material reserve on the feed section. The tubular goods are then continuously transported out of the goods buffer on the feed section of the circular spreader at a predetermined second transport velocity, and transported further over the main body section of the circular spreader to be subjected to the heat fixing process in the heat fixing chamber.

The invention may especially include the following features. The tubular goods are first subjected to a steam treatment in a heating chamber, which itself may be per se conventional. The goods are deflected back and forth at least once in the heating chamber and are then delivered continuously at the first transport velocity to the cone-shaped feed section of the circular spreader. The supplied tubular goods form a tubular goods buffer or excess reserve of the tubular goods on the feed section of the circular spreader while temporarily relaxing and possibly shrinking. Next, the tubular goods are continuously transported out of the goods buffer or reserve on the feed section at a second transport velocity that is for example, less than the first transport velocity. Thereby, the tubular goods are transported in a circular expanded condition in a downward vertical direction from the top toward the bottom over the circular spreader while undergoing the heat fixing process. During this downward vertical transport of the tubular goods, the weight of the goods contributes to the downward transport and allows the tension in the goods to be reduced.

As an alternative, the first and second transport velocities can be equal to each other, as long as the first drive and therewith the supply of the tubular goods to the feed section of the circular spreader is operated with a leading advance relative to the second drive that further transports the tubular goods at the second transport velocity from the feed section over the rest of the circular spreader. This leading advance supply of the tubular goods to the feed section of the circular spreader means that an advance reserve quantity of the tubular goods is supplied ahead of or before the transport demand at which the goods are transported away at the second transport velocity. As a simple example, the supply of the goods to the feed section is started a short delay time before starting the transport of the goods away from the feed section, whereby the goods buffer is built up during that short delay time.

The inventive apparatus for carrying out the above method includes a preheating chamber with a steamer device, and downstream thereof a heat or thermal fixing chamber with a circular internal expander or spreader arranged therein. An inlet or feed section of the circular spreader including a spreader head is arranged at the top of or actually above the heat fixing chamber. Various feed rollers and deflection rollers are arranged to transport the goods in a downward vertical direction onto the inlet or feed section and then downwardly over the remainder of the circular spreader through the heat fixing chamber. In this specification, the terms "upstream" and "downstream" define relative positions with respect to the normal flow or travel direction of the goods along a goods travel path from the beginning to the end of the treatment process through the treatment apparatus.

The inventive method and apparatus achieve the following advantages. The vertically downward transport of the tubular goods, in the circular expanded condition over the circular spreader, from the top to the bottom thereof, beneficially uses the weight and gravitational acceleration of the tubular goods to contribute to the transport. Therefore, the amount of required transport power is reduced, and as a result, the electric motors driving the various drive rollers and the like have a reduced power requirement. Also, as a result of the beneficial gravitational influence, the longitudinal tension of the tubular goods is minimized, which in turn has a positive effect on achieving the desired fixed structure of the knit tubular goods. The formation of a goods buffer in the inlet feed section of the circular spreader gives the goods an opportunity to relax and possibly to shrink in length and width, at least during the time the goods are temporarily stored in this goods buffer or reserve, until the goods are transported out of the buffer at the second transport velocity into the heat fixing chamber.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Many aspects of the present inventive method and apparatus for treating tubular knit goods are the same or similar to such aspects described in U.S. Pat. No. 6,016,591 (Strudel et al.), the disclosure of which is incorporated herein by reference. Familiarity with that disclosure is assumed, and many of the detailed features that are common to the present invention and the prior patent will not be described again herein.

Figure 1:
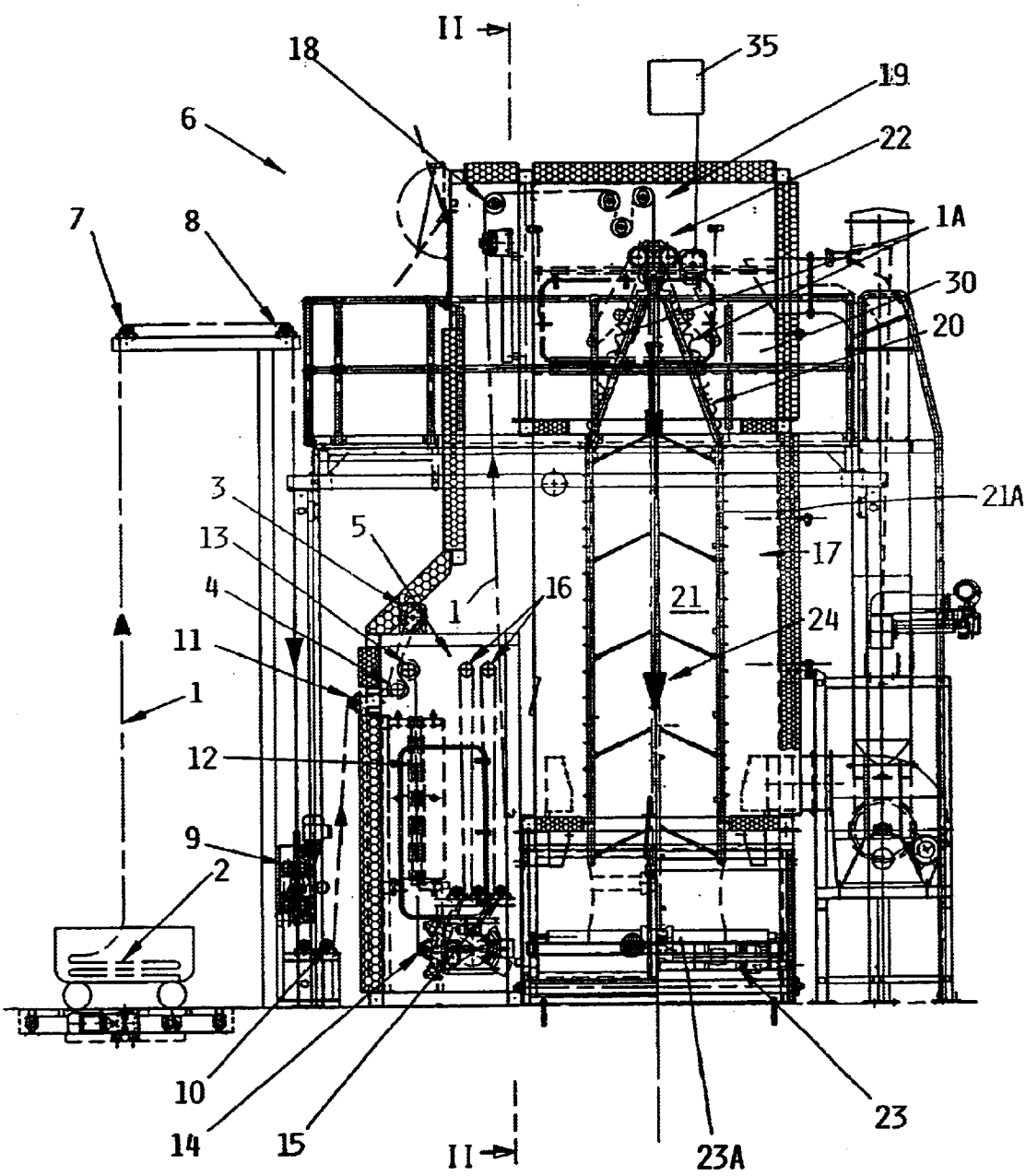
FIG. 1 is a schematic sectioned or broken-open view of the internal arrangement of a treating apparatus, including a preheating chamber and a heat fixing chamber, for treating tubular knit goods according to the invention.

As shown in present FIG. 1, the tubular knit goods 1 are initially supplied in a supply stack 2 of the raw tubular knit goods in a flattened and folded configuration. The goods 1 are removed from this supply stack 2 in a generally known manner using at least one drawing-off roller 4 that is rotationally driven by at least one electric motor drive 3. In the present illustrated example, the drawing-off roller 4 is located within a preheating chamber 5 of the treatment apparatus 6, but various different locations are also possible. Before the goods 1 are transported into the preheating chamber 5, the goods 1 are pulled in a flattened condition over two deflection rollers 7 and 8 located vertically above the goods supply stack 2, and from there are transported to a generally known flat spreader device 9 which is arranged approximately below a goods inlet roller 11 of the preheating chamber 5. From the flat spreader device 9, the knit goods 1 are transported in the flat spread-out condition over at least one deflection roller 10 located downstream or after the flat spreader device 9, and from the deflection roller 10 to the above mentioned goods inlet roller 11, from which the goods 1 are pulled by the drawing-off roller 4 into the preheating chamber 5.

A goods steamer 12 is arranged in the preheating chamber 5. The goods 1 are transported from the drawing-off roller 4 over a deflection roller 13 arranged with its axis parallel to the drawing-off roller 4, and from there vertically through the steamer arrangement 12, vertically downward from its inlet to its outlet, in the pre-heating chamber 5. After leaving the steamer arrangement 12, the goods 1 are transported, in a generally known manner, over at least one floating compensating roller 14 and then over plural first deflection rollers 15 and plural second deflection rollers 16 that are all arranged with their axes parallel to each other, whereby the first deflection rollers 15 and the second deflection rollers 16 are vertically spaced apart from each other. Thereby, the goods 1 are transported in a zig-zag fashion back and forth successively between deflection rollers 15 and deflection rollers 16 through the preheating chamber 5.

After leaving the last deflection roller 15 in the preheating chamber 5, the goods 1 are transported further to at least one roller arrangement 18, 19 that is located vertically above the preheating chamber 5 and a heat fixing chamber 17 of the apparatus 6. From the roller arrangement 18, 19, the goods 1 are further supplied from the last roller of the arrangement 19 vertically downwardly via a spreader head 22 onto the conically configured inlet or feed section 20 of a circular internal expander or spreader 21, of which the main body section 21A is arranged within the heat fixing chamber 17, and the feed section 20 is preferably arranged above the heat fixing chamber 17 in a buffer zone 30 of the apparatus 6. The spreader head 22 includes an electric motor drive 22B (see FIG. 2) which rotatingly drives the fixing roller 22A of the spreader head 22, so as to transport the goods 1 onto the inlet or feed section 20. The drive speed of the electric motor drive 22B is controllable via an electronic controller 35, so as to control the transport velocity of the goods 1 onto the feed section 20 of the circular spreader 21.

Figure 2:
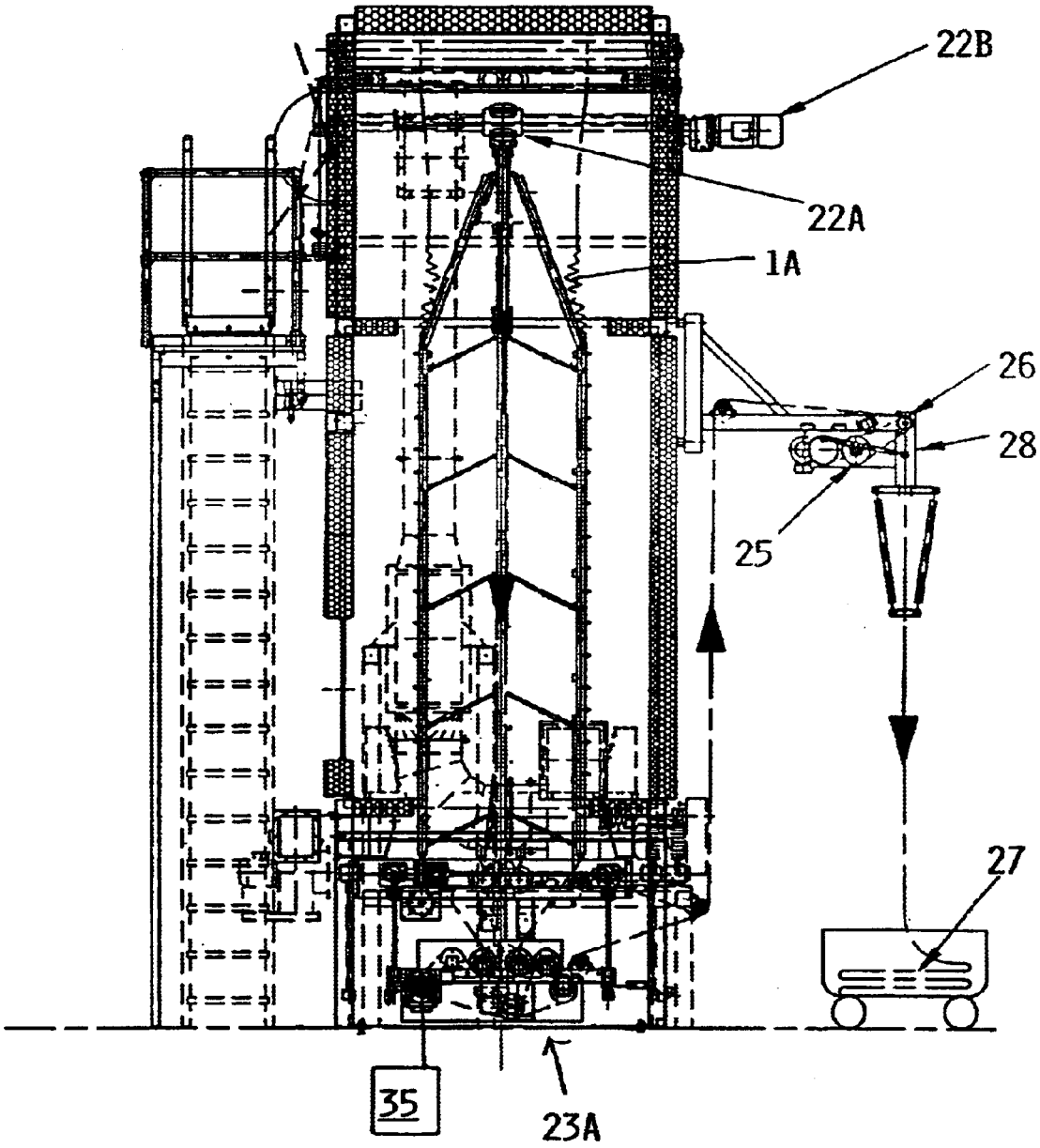
FIG. 2 is a schematic view of the treating apparatus of FIG. 1, as seen along the plane II—II in FIG. 1.

According to a particular embodiment of the inventive method, the goods 1 are transported by means of the drive 22B onto the feed section 20 of the circular spreader 21 at a predetermined first transport velocity, which is greater than the second transport velocity that is necessary for fixing the goods as the goods are transported over the main body section 21A of the circular spreader 21 in the heat fixing chamber 17. Thereby, it is possible to form or build-up a goods buffer 1A or excess reserve 1A on the feed section 20 of the circular spreader 21. This goods buffer 1A comprises an excess slack amount of the goods 1, which are loosely folded or slumped onto the conical feed section 20, as represented by the wavy or undulating line of the goods 1 forming the goods buffer 1A as shown in FIGS. 1 and 2. This loose excess amount of the goods 1 forming the goods buffer 1A allows the goods in the buffer 1A temporarily to relax and possibly also to shrink in width and length.

From there, the goods 1 are further transported by a second electric motor drive 23 which drives at take-off roller arrangement 23A at the bottom of the circular spreader 21, by means of which the goods 1 are pulled in a vertically downward direction 24 from the goods buffer 1A on the feed section 20, over the remaining body section 21A of the circular spreader 21, downwardly through the heat fixing chamber 17, at a second transport velocity that is less than or slower than the first transport velocity. The second transport velocity established by the second drive 23 is also controllable by the electronic controller 35, based on operator inputs of desired transport velocities or selection of pre-programmed operating modes or combinations of the first and second transport velocities and operating sequences. The controller 35 is connected for control signal transmission, e.g. via electrical conductors, to any drive which is to be controlled thereby.

The above mentioned difference between the first and second transport velocities would result in an ever-increasing excess quantity of the goods 1 accumulating in the goods buffer 1A during the operation of the method. If such an effect is to be avoided, it is alternatively possible to control the electric motor drives 22B and/or 23 via the controller 35 so that the first transport velocity is equal to the second transport velocity, either from the time of initially starting the process, or only after a sufficient goods buffer 1A has been built up. If the two transport velocities of the drives 22B and 23 are to be equal right from the beginning of the process, it will be necessary to operate the first drive 22B for a short time before starting the second drive 23, so as to supply the goods 1 with a leading advance relative to the take-off of the goods by the second drive 23, so as to thereby build-up the required goods buffer 1A before starting the second drive 23.

While being transported over the circular spreader 21 through the heat fixing chamber 17, the goods 1 will be thermally fixed in diameter and fiber structure. This is achieved by holding the goods 1 in a particular expanded condition while subjecting the goods to an appropriate temperature for heat-setting the existing expanded condition of the fibers of the goods. For this purpose, the heat fixing chamber is tempered as needed, e.g. insulated and/or temperature/controlled. Then, after leaving the circular spreader 21, the fixed goods 1 will be flattened from the circular expanded condition to a flattened condition, which is then transported over suitable deflection rollers to a roller 26 that is rotationally driven by an electric motor drive 25 and integrated into a folder device 28, which folds the flattened fixed goods 1 back and forth to form an output or delivery stack 27 of the treated goods.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for treating tubular textile goods comprising:

a steaming device adapted to apply steam to the goods;

a circular spreader including a substantially conical feed section and including a substantially cylindrical main section arranged in a tempered heat fixing chamber;

a driven feed roller device arranged on a goods transport path between said steaming device and said feed section of said circular spreader and adapted to feed the goods onto said feed section at a first transport velocity;

a driven take-off roller device arranged on said goods transport path downstream from said main section of said circular spreader and adapted to pull the goods from said feed section along said main section of said circular spreader at a second transport velocity; and a controller connected for control signal transmission to said driven feed roller device and said driven take-off roller device for controlling said driven feed roller device and said driven take-off roller device so as to form a goods buffer of a loose excess amount of the goods on said feed section of said circular spreader.

2. An apparatus for treating tubular textile goods comprising:

a steaming device adapted to apply steam to the goods;

a circular spreader including a substantially conical feed section and including a substantially cylindrical main section arranged in a tempered heat fixing chamber, wherein said circular spreader extends longitudinally along a vertical axis with said feed section above said main section;

a driven feed roller device arranged above said feed section of said circular spreader on a goods transport path between said steaming device and said feed section of said circular spreader, and adapted to feed the goods downwardly onto said feed section at a first transport velocity; and a driven take-off roller device arranged below said circular spreader on said goods transport path downstream from said main section of said circular spreader and adapted to pull the goods downwardly from said feed section along said main section of said circular spreader at a second transport velocity.

3. A method of treating tubular textile goods in an apparatus including a steaming device, and a circular spreader that includes a feed section and a main section which is arranged in a heat fixing chamber, said method comprising the steps:

a) applying steam to said goods with said steaming device;

b) after said step a), feeding said goods onto said feed section of said circular spreader at a first transport velocity so as to form a temporary goods buffer of an excess quantity of said goods on said feed section;

c) drawing off said goods from said temporary goods buffer on said feed section onto and along said main section of said circular spreader at a second transport velocity, and heat-fixing said goods in said heat fixing chamber while said goods are circularly spread on said main section of said circular spreader;

wherein said steps b) and c) are carried out so as to establish and maintain said goods buffer on said feed section.

4. The method according to claim 3, further comprising continuously carrying out said feeding in said step b) and said drawing off in said step c), and continuously maintaining said goods buffer.

5. The method according to claim 3, wherein said first transport velocity is greater than said second transport velocity, and said goods buffer is formed due to a transport velocity difference therebetween.

6. The method according to claim 3, further comprising beginning said feeding in said step b) before said drawing off in said step c) so as to form said goods buffer and then carrying out said feeding and said drawing off with said first transport velocity and said second transport velocity being equal to each other.

7. The method according to claim 3, wherein said circular spreader extends longitudinally along a vertically oriented longitudinal axis, and wherein said feeding and said drawing off comprise vertically transporting said goods in a vertical direction.

8. The method according to claim 7, wherein said feed section is arranged vertically above said main section of said circular spreader, and wherein said transporting of said goods comprises transporting said goods vertically downwardly from said feed section along said main section of said circular spreader.

9. The method according to claim 3, wherein said step b) comprises forming said goods buffer above and outside of said heat fixing chamber.

10. The method according to claim 3, wherein said goods are knit goods including natural fibers and synthetic elastomeric fibers, and wherein said heat-fixing of said goods comprises thermally setting said synthetic elastomeric fibers.

11. The method according to claim 3, further comprising relaxing said goods in said goods buffer.

12. The method according to claim 3, wherein said feed section of said circular expander has a substantially conical configuration, and said forming of said goods buffer comprises loosely bunching said excess quantity of said goods on said feed section.

13. A method of treating tubular textile goods in an apparatus including a steaming device, and a circular spreader that includes a feed section and a main section which is arranged to extend longitudinally vertically in a heat fixing chamber with said feed section vertically above said main section, said method comprising the steps:

a) applying steam to said goods with said steaming device;

b) after said step a), feeding said goods downwardly onto said feed section of said circular spreader at a first transport velocity; and c) drawing off said goods from said feed section downwardly onto and along said main section of said circular spreader at a second transport velocity, and heat-fixing said goods in said heat fixing chamber while circularly spreading and vertically downwardly moving said goods on said main section of said circular spreader.

* * * * *

UNITED STATES PATENT AND TRADEMARK OFFICE

CERTIFICATE OF CORRECTION

PATENT NO. : 6,663,678 B2
DATED : December 16, 2003
INVENTOR(S) : Strudel et al.

It is certified that error appears in the above-identified patent and that said Letters Patent is hereby corrected as shown below:

Title page,
Item [*] Notice, delete the phrase "by 197 days" and insert -- by 118 days --

Signed and Sealed this

Fifth Day of October, 2004

JON W. DUDAS
*Director of the United States Patent and Trademark Office*